US008956483B2

(12) United States Patent
Chung et al.

(10) Patent No.: US 8,956,483 B2
(45) Date of Patent: Feb. 17, 2015

(54) MANUFACTURING METHOD OF CASING OF HEAT PIPE

(71) Applicants: Ming-Hsiu Chung, New Taipei (TW); Nien-Tien Cheng, New Taipei (TW)

(72) Inventors: Ming-Hsiu Chung, New Taipei (TW); Nien-Tien Cheng, New Taipei (TW)

(73) Assignee: Foxconn Technology Co., Ltd., New Taipei (TW)

( * ) Notice: Subject to any disclaimer, the term of this patent is extended or adjusted under 35 U.S.C. 154(b) by 0 days.

(21) Appl. No.: 13/659,918

(22) Filed: Oct. 25, 2012

(65) Prior Publication Data

US 2013/0269858 A1 Oct. 17, 2013

(30) Foreign Application Priority Data

Apr. 16, 2012 (TW) ..... 101113385 A

(51) Int. Cl.
*C03B 29/00* (2006.01)
*F28D 15/00* (2006.01)
*B23P 6/00* (2006.01)

(52) U.S. Cl.
USPC ..... 156/89.11; 165/104.19; 165/104.26; 165/104.21; 29/890.032

(58) Field of Classification Search
USPC ..... 156/89.11; 165/185, 104.19, 104.26, 165/104.21; 29/890.032
See application file for complete search history.

(56) References Cited

U.S. PATENT DOCUMENTS

| | | | | |
|---|---|---|---|---|
| 4,697,205 | A * | 9/1987 | Eastman | 257/715 |
| 5,977,230 | A * | 11/1999 | Yang et al. | 524/389 |
| 6,564,860 | B1 * | 5/2003 | Kroliczek et al. | 165/104.26 |
| 6,997,245 | B2 * | 2/2006 | Lindemuth et al. | 165/104.26 |
| 7,213,637 | B2 * | 5/2007 | Lin et al. | 165/104.26 |
| 7,237,337 | B2 * | 7/2007 | Yeh et al. | 29/890.032 |
| 7,246,655 | B2 * | 7/2007 | Mochizuki et al. | 165/104.26 |
| 2003/0136550 | A1 * | 7/2003 | Tung et al. | 165/104.26 |
| 2006/0124281 | A1 * | 6/2006 | Rosenfeld et al. | 165/104.26 |
| 2009/0159242 | A1 * | 6/2009 | Zhao et al. | 165/104.26 |
| 2010/0126701 | A1 * | 5/2010 | Hou | 165/104.26 |
| 2011/0083835 | A1 * | 4/2011 | Chen et al. | 165/185 |

* cited by examiner

*Primary Examiner* — Alex Efta

(74) *Attorney, Agent, or Firm* — Novak Druce Connolly Bove + Quigg LLP

(57) ABSTRACT

A method for manufacturing a casing of a heat pipe includes steps: providing a hollow mold; injecting a feedstock of powder and molten binder into the mold under pressure, thus forming a desired body of a first shell and a desired body of a second shell; separating the binder from the body of the first shell and the body of the second; sintering the body of the first shell and the body of the second shell, thereby forming the first shell and the second shell; and mounting the second shell on the first shell and sintering the first shell and the second shell together, thereby forming the casing of the heat pipe.

5 Claims, 3 Drawing Sheets

MANUFACTURING METHOD OF CASING OF HEAT PIPE

BACKGROUND

1. Technical Field

The disclosure relates to a manufacturing method of a casing of heat pipe.

2. Description of the Related Art

Heat pipes have excellent heat transfer performance due to their low thermal resistance, and are therefore an effective means for transfer or dissipation of heat from heat sources. Currently, heat pipes are widely used for removing heat from heat-generating components such as central processing units (CPUs) of computers.

A heat pipe is usually a vacuum casing containing a working medium therein. The working medium is employed to carry, under phase transitions between liquid state and vapor state, thermal energy from an evaporator section to a condenser section of the heat pipe. Preferably, a wick structure is provided inside the heat pipe, lining an inner wall of the casing, for drawing the working medium back to the evaporator section after it is condensed at the condenser section. A flat heat pipe is usually made by flatting a round heat pipe. However, the casing of the heat pipe is easily damaged in a machining process thereby reducing the heat transfer capability of the heat pipe.

Therefore, it is desirable to provide a manufacturing method of a casing of a heat pipe having a satisfactory heat transfer capability without the casing being flattened.

BRIEF DESCRIPTION OF THE DRAWINGS

The components of the drawings are not necessarily drawn to scale, the emphasis instead being placed upon clearly illustrating the principles of the embodiments of the display device. Moreover, in the drawings, like reference numerals designate corresponding parts throughout several views.

DETAILED DESCRIPTION

Figure 1:
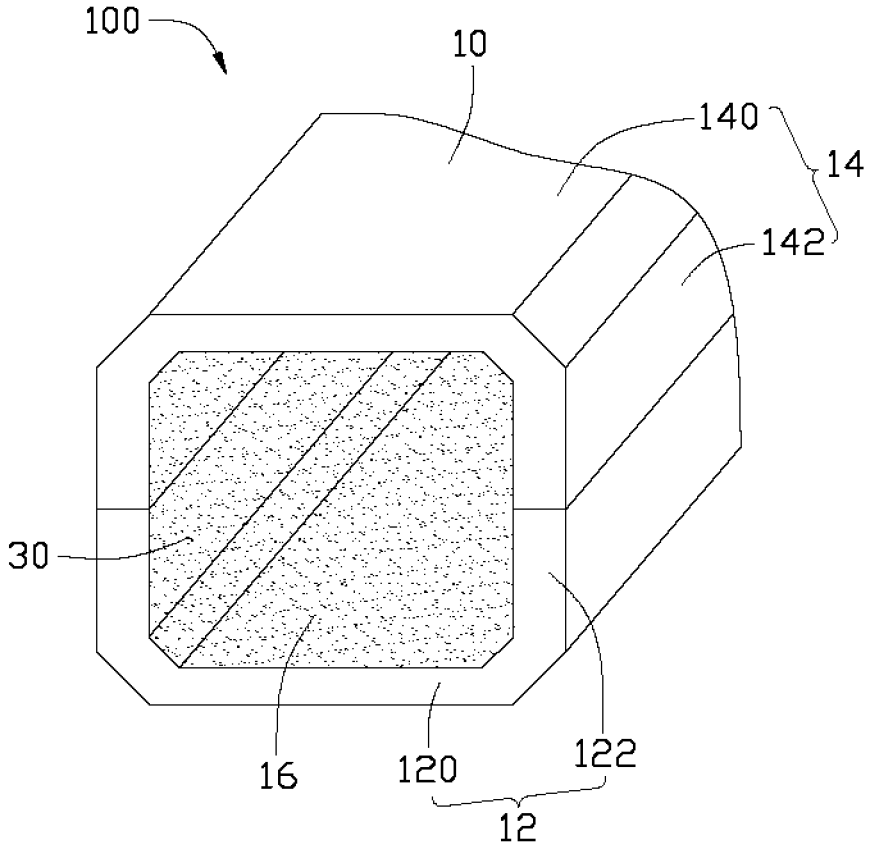
FIG. 1 is an isometric, assembled view of a heat pipe, according to an embodiment of the present disclosure.

Referring to FIG. 1, a heat pipe 100 in accordance with an embodiment of the disclosure is shown. The heat pipe 100 includes a casing 10 and a wick structure enclosed in the casing 10.

Figure 2:
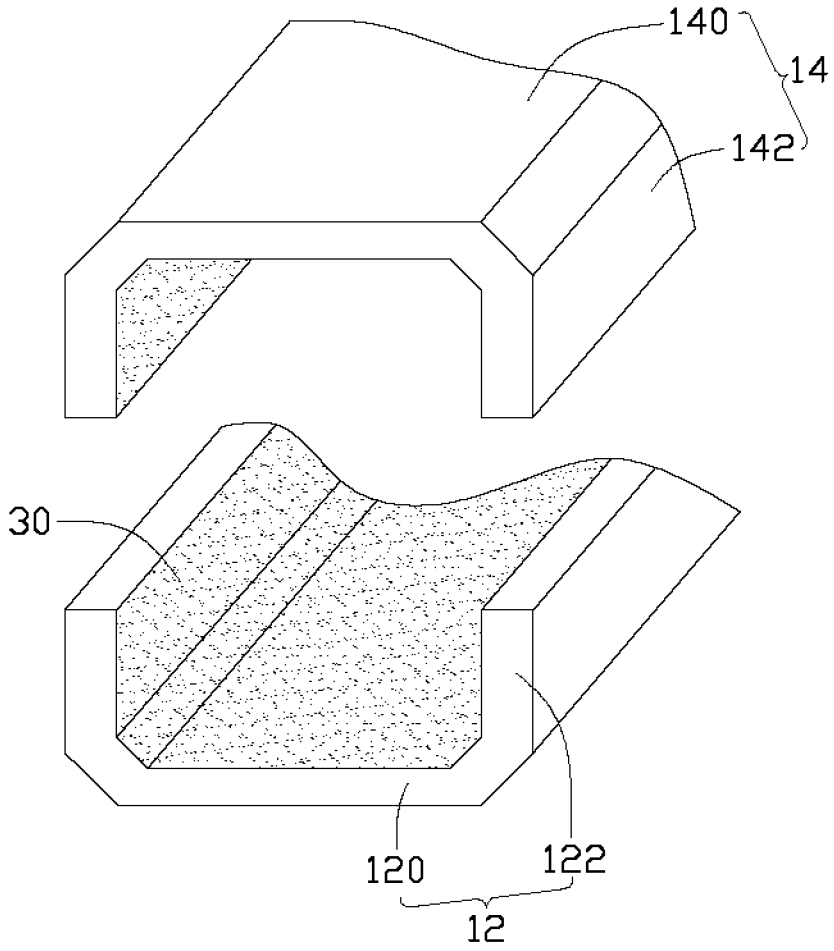
FIG. 2 is an exploded view of the heat pipe of FIG. 1.

Referring also to FIG. 2, the casing 10 is made of high thermally conductive material such as copper or aluminum. The casing 10 includes a first shell 12 and a second shell 14 opposite to the first shell 12. The first shell 12 includes a base 120 and two lateral walls 122 upwards extending from two sides of the base 120, respectively. The second shell 14 includes a cover 140 opposite to the base 120 of the first shell 12, and two lateral walls 142 downwards extending from two sides of the cover 140, respectively. The lateral walls 122 of the first shell 12 and the lateral walls 142 are fixed to each other thereby defining a receiving room 16. A working medium is injected into the receiving room 16. The working medium is usually selected from a liquid, such as water, methanol, or alcohol, which has a low boiling point. Inner walls of the first shell 12 and the second shell 14 form rough structure thereby forming a wick structure 30.

Figure 3:
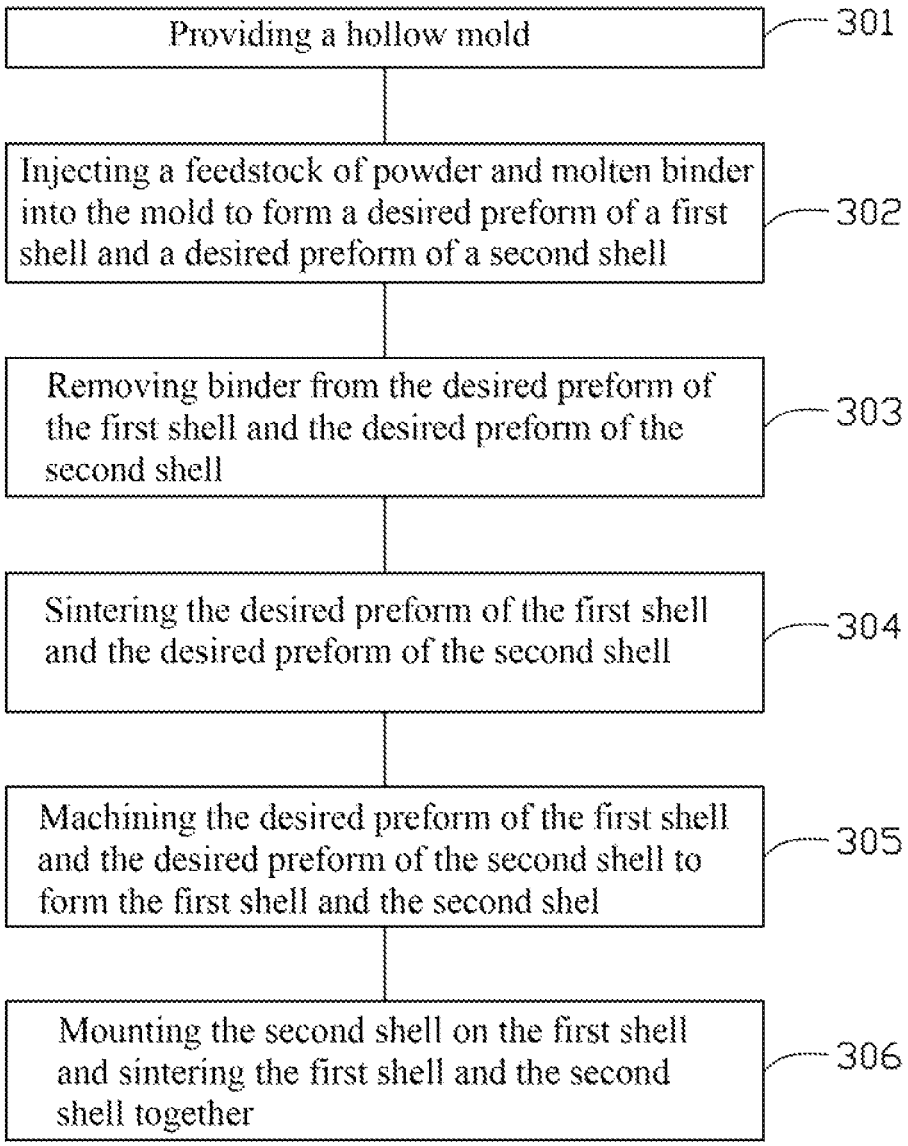
FIG. 3 is a flow chart of a method employed in manufacturing a casing of the heat pipe of FIG. 1.

Referring to FIG. 3, a manufacturing method of the heat pipe 100 includes following steps of:

step 301: providing a hollow mold (not shown) with inner walls forming rough structure.

step 302: injecting a feedstock of powder and molten binder into the mold under pressure, thus forming a desired body (i.e. a semifinished product with predetermined shape) of the first shell 12 and a desired body of the second shell 14, inner walls of the desired bodies of the first shell 12 and the second shell 14 being formed with rough structure thereby forming the wick structure 30.

step 303: separating the binder from the body of the first shell 12 and the body of the second shell 14.

step 304: sintering the body of the first shell 12 and the body of the second shell 14.

step 305: performing a precision machining to the body of the first shell 12 and the body of the second shell 14, thereby forming the first shell 12 and the second shell 14.

step 306: mounting the second shell 14 on the first shell 12 and sintering the first shell 12 and the second shell 14 together, thereby forming the casing 10 of the heat pipe 100.

The casing 10 of the heat pipe 100 is configured (i.e., structured and arranged) for mass-production by the method in accordance with the preferred embodiment of the present disclosure. Also, the casing 10 of the heat pipe 100 manufactured by the present method has good intensity facilitated process.

Alternatively, in other embodiment, the heat pipe 100 can be L-shaped or U-shaped, and the wick structure 30 can be grooved wick structure or screen mesh wick structure.

It is to be further understood that even though numerous characteristics and advantages have been set forth in the foregoing description of the embodiment(s), together with details of the structures and functions of the embodiment(s), the disclosure is illustrative only; and that changes may be made in detail, especially in the matters of shape, size, and arrangement of parts within the principles of the disclosure to the full extent indicated by the broad general meaning of the terms in which the appended claims are expressed.

What is claimed is:

1. A method for manufacturing a casing of a heat pipe comprising:

providing a mold which is hollow;

injecting a feedstock of powder and molten binder into the mold and forming a body of a first shell, a body of a second shell, and wick structures on inner walls of the first shell body and the second shell body;

separating the binder from the body of the first shell and the body of the second shell;

sintering the body of the first shell and the body of the second shell, thereby forming the first shell and the second shell; and mounting the second shell on the first shell and sintering the first shell and the second shell together, thereby forming the casing of the heat pipe.

2. The method of claim 1, wherein polyethylene is used as a material of the binder of the feedstock.

3. The method of claim 2, wherein the binder of the feedstock is removed by debinding or extraction.

4. The method of claim 1, wherein a machining operation is performed on the first shell and the second shell before the first shell and the second shell are sintered together.

5. The method of claim 1, wherein the first shell comprises a base and two lateral walls extending from two sides of the base, the second shell comprising a cover opposite to the base of the first shell and two lateral walls extending from two sides of the cover, the lateral walls of the first shell being sintered with corresponding lateral walls of the second shell.

* * * * *